US005540647A

United States Patent [19]

Weiermann et al.

[11] Patent Number: 5,540,647

[45] Date of Patent: Jul. 30, 1996

[54] FOLDING APPARATUS FOR AUTOMATIC FOLDING OF FLATWORK

[75] Inventors: Paul Weiermann, Wynigen; Martin Bronnimann, Ostermundigen, both of Switzerland

[73] Assignee: Jensen AG Burgdorf, Burgdorf, Switzerland

[21] Appl. No.: 194,463

[22] Filed: Feb. 8, 1994

[30] Foreign Application Priority Data

Feb. 18, 1993 [EP] European Pat. Off. ..... 93810097

[51] Int. Cl.[6] ..... B65H 45/16; B65H 45/14; B65H 45/00

[52] U.S. Cl. ..... 493/444; 493/25; 493/29; 493/34; 493/441; 493/938; 223/37

[58] Field of Search ..... 493/2, 3, 8, 9, 493/13, 10, 14, 15, 17, 18, 23, 25, 29, 47, 418, 437, 441, 444, 445, 938, 34; 223/37, 38; 270/32, 45, 51; 198/620, 604

[56] References Cited

U.S. PATENT DOCUMENTS

| | | | |
|---|---|---|---|
| 2,777,689 | 1/1957 | Martin | 493/25 |
| 2,834,595 | 5/1958 | Gilchrist | 493/25 |
| 2,858,128 | 10/1958 | Buss | 493/418 |
| 3,310,207 | 3/1965 | Gore | 493/418 |
| 3,589,709 | 6/1971 | Hey | 493/25 |
| 3,706,450 | 12/1972 | Gerstenberger et al. | 493/25 |
| 3,829,081 | 8/1974 | Gerstenberger et al. | 493/418 |
| 3,905,593 | 9/1975 | Behn | 493/441 |
| 3,980,290 | 9/1976 | Sjoman et al. | 493/441 |
| 4,060,227 | 11/1977 | Landgraf | 493/25 |
| 4,234,179 | 11/1980 | Weir | 493/418 |
| 5,007,891 | 4/1991 | Von Hein | 493/444 |
| 5,057,064 | 10/1991 | Michalik | 493/8 |
| 5,061,230 | 10/1991 | Buxton | 493/25 |
| 5,242,364 | 9/1993 | Lehmann | 493/34 |
| 5,344,379 | 9/1994 | Garrone | 493/441 |

FOREIGN PATENT DOCUMENTS

| | | | |
|---|---|---|---|
| 0354176 | 2/1990 | European Pat. Off. | 493/23 |

*Primary Examiner*—Jack W. Lavinder
*Assistant Examiner*—Christopher W. Day
*Attorney, Agent, or Firm*—Oblon, Spivak, McClelland, Maier & Neustadt, P.C.

[57] ABSTRACT

The folding apparatus for automatic folding of flatwork includes a longitudinal folder and a transverse folder following thereafter. In the transverse folder there are two laundry conveyors disposed one behind the other in the conveying direction of a flatwork article arriving from the longitudinal folder. They are spaced apart by a gap stretching essentially across the entire width of the transverse folder. To make a first transverse fold using a folding blade or air blast, a flatwork article to be transversely folded is led into the gap. Prior to this step, the thickness of the flatwork article to be folded is entered into a data entry device or is determined using a measuring device. The width of the gap is adjustable, depending upon the particular thickness of the flatwork article. In this manner optimal conveying along the gap is achieved of a flatwork article having a first transverse fold, independent of thickness. A further laundry conveyor is disposed at the exit end of the gap and the course of its belts located in the area of the said gap end can be changed by adjusting an adjustment roller. Following the making of a second transverse fold, the belts can be lowered in the said area, by which the flatwork article can reach the output location without having to queue up at a narrow point.

20 Claims, 5 Drawing Sheets

FOLDING APPARATUS FOR AUTOMATIC FOLDING OF FLATWORK

BACKGROUND OF THE INVENTION

1. Field of the Invention

The present invention concerns a folding apparatus for automatic folding of flatwork, in particular articles of clothing, with a machine frame, with a longitudinal folder and a subsequently disposed transverse folder, two laundry conveyors being provided disposed in the transverse folder one behind the other in the conveying direction of a flatwork article arriving from the longitudinal folder, and being spaced apart by a gap stretching essentially across the entire width of the transverse folder, and a flatwork article being introducible into the gap while a first transverse fold is made.

2. Discussion of the Background

Folding apparatuses of this type are known. They generally comprise a feed conveyor, on which a flatwork article to be folded is placed, spread out, and is fed to the folding device. The flatwork article arrives at a longitudinal folder, where it is folded once or twice, depending upon the width. The flatwork article lies thereby on belts of a conveyor, one or both of the side edges of the flatwork article parallel to the conveyor belts being turned inward using a folding blade while forming a longitudinal fold. The longitudinally folded flatwork article is conveyed further and is passed to a transverse folder adjoining the longitudinal folder. Here there are usually two laundry conveyors, spaced apart, one behind the other in the conveying direction of the flatwork article. Between the conveyors there is a gap. The flatwork article is conveyed over the two said conveyors until the place on the flatwork article where a transverse fold is to be made lies over the said gap. The conveyor operated subsequently in the said conveying direction reverses its conveying direction while at the same time the flatwork article is pressed into the gap while a first transverse fold is made using a folding blade or an air blast. The gap stretches from the conveyor surface of the said laundry conveyor inclined downward, preferably at an angle of about 90°. The flatwork article, now folded once crosswise, passes through this gap and is turned to the left or to the right at the exit point while a second transverse fold is formed, and is thereby placed on a further laundry conveyor disposed below the two said laundry conveyors and which extends to the left and to the right of the gap. The turning of the flatwork article to the one side or to the other is determined by the folding program, depending upon whether the leading edge of the folding flatwork article is supposed to lie inside or outside. The further laundry conveyor is also designed to carry the flatwork article out of the folding apparatus after the second transverse fold has been made.

Although a folding apparatus of this kind, as can be seen in principle in FIG. 1, operates rather reliably, certain difficulties nevertheless arise which must be paid attention to in folding flatwork articles of differing thicknesses, such as, for example, a thin blouse or thick work clothes. The gap opening or gap width is to be adjusted each time to the thickness of the flatwork article so that the article can be perfectly conveyed along the gap. The range of adjustment is large. Up to now the gap width has been adjusted to the flatwork article using spring means. In introducing a flatwork article into the gap using the folding blade, the gap width opens as far as necessary owing to the force of the flatwork article itself. Difficulties have arisen when the gap opening has been adjusted to the thinnest flatwork to be folded and the opening force for thick flatwork has been too great, or when, to prevent the foregoing, the basic setting of the gap width is adjusted to flatwork of average thickness, and extremely thin flatwork articles therefore could no longer be conveyed into the gap perfectly, but practically fell down into the gap. Foreseen also has been manual adjustment to the most advantageous gap width prior to folding a series of articles of the same kind. This is laborious and requires an experienced person to avoid several attempts being made.

Until today a similar problem has arisen in carrying out the completely folded flatwork article on the aforementioned further laundry conveyor. Especially with thick flatwork, the outer-lying leading edge of the flatwork article has been caught at the too narrow inlet of this conveyor. The article has had to be removed and refolded.

Due to these problems, allowances have had to be made for reduced quality in folding.

It is the object of the present invention to eliminate these described difficulties by improving the folding apparatus.

The first named difficulty is overcome with a folding apparatus wherein means are foreseen to change the gap width and to adjust to the type of flatwork article before the flatwork article is introduced.

The second named difficulty can be avoided if the folding apparatus is additionally equipped so that below the two laundry conveyors there is a further laundry conveyor, wherein the further laundry conveyor is driven reversibly and has two upper conveyor sections and one lower conveyor section, the first upper conveyor section being disposed below the first laundry conveyor and the second upper conveyor section being disposed below the second laundry conveyor, and the lower conveyor section of the further laundry conveyor extending below both of the upper conveyor sections, and adjustment means are provided to change the course of belts of the lower conveyor section of the further laundry conveyor in the area of the gap, or, respectively of the ends turned toward each other of the upper conveyor sections.

Foreseen as means to adjust the gap width are preferably pneumatic cylinders. However, other means could be used just as well, such as, for example, hydraulic cylinders, electromotors with gearing, etc. In addition to this adjustment of the gap width, the previously mentioned spring action could still be maintained for fine adjustment only; this would be when the closing cylinder for the gap width is driven by an adjustable pressure reducing valve.

The type of flatwork article, such as a blouse, a jacket, apron, overall, etc., can be entered, for example, into a data entry device, and conseqently its thickness can be determined to a large extent, and thus the gap width. This type of operation is advantageous when a series of like flatwork articles has to be folded.

Another embodiment foresees direct determination of the thickness of the flatwork article already folded longitudinally using, for example, a measuring device which can be disposed in the longitudinal folder or directly at the entrance to the transverse folder. This can take place, for example, in that using a photoelectric barrier with a light band, the layer height of the longitudinally folded flatwork article on conveyor belts is measured.

A third possibility foresees measuring the length of the flatwork article to be folded with a measuring device, and of categorizing the flatwork article based on the length. For example, blouses, aprons, overalls have typical lengths for their categories, with relatively small deviations. Based on the type of flatwork article determined in this way, the gap width can be adjusted. To measure the length of a flatwork article a light barrier would suffice which can measure the time it takes the flatwork article to pass through it. Using the known conveying speed, the length of the flatwork article can be easily calculated.

A preferred embodiment of the transverse folder foresees only one laundry conveyor being displaceably disposed to change the gap width. In the embodiment shown, this is the conveyor disposed after the gap, seen in the conveying direction of the flatwork article. The conveyor disposed before the gap is thus stationary. Interchanging the stationary and displaceable laundry conveyors would also be conceivable. Adjustment of the gap width can be controlled in such a way that this can take place before introduction of the flatwork article into the gap. It could also operate in that just when the flatwork article is introduced into the gap, the gap is completely open, or is opened completely for a short time, and only a little while later, after the formation of the transverse fold, the gap width is set to the value determined previously.

A preferred embodiment foresees that the gap width can assume three predefined values using adjustment means. In feeding the flatwork article arriving in the transverse folder into the gap, the folding blade and/or air blast can always be introduced at the center of the gap, owing to its being disposed on the pivoted lever, regardless of the position of the displaceable laundry conveyor.

While the direction of feed of a flatwork article into the transverse folder is essentially horizontal, and is determined by the support surface of the two laundry conveyors one behind the other, the gap extends downward preferably at approximately a right angle to the said direction. Disposed at the lower end of the gap is a further laundry conveyor, which extends to the right and to the left, relative to the gap and about parallel to the said direction of feed of the flatwork article. Depending upon the type of fold, the flatwork article is turned to the right or to the left to make a second transverse fold. The completely folded flatwork article is carried out of the transverse folder via the further laundry conveyor, which is at the same time the discharge conveyor. By means of the adjustability of the belt of the further conveyor in the area of the lower end of the gap, both the turning of the flatwork article arriving through the gap in the desired direction is facilitated and above all the completely folded flatwork article can be carried out without piling up at any location.

Particularly advantageous is that the belt of the further conveyor can be lowered in the area of the lower gap end before carrying out the flatwork article so that the entrance to the discharge conveyor section is wider and the piling up of thick flatwork articles can be prevented.

BRIEF DESCRIPTION OF THE DRAWINGS

The present invention will be explained in more detail in the following using a preferred embodiment with reference to the drawing in which.

DESCRIPTION OF THE PREFERRED EMBODIMENTS

Figure 1:
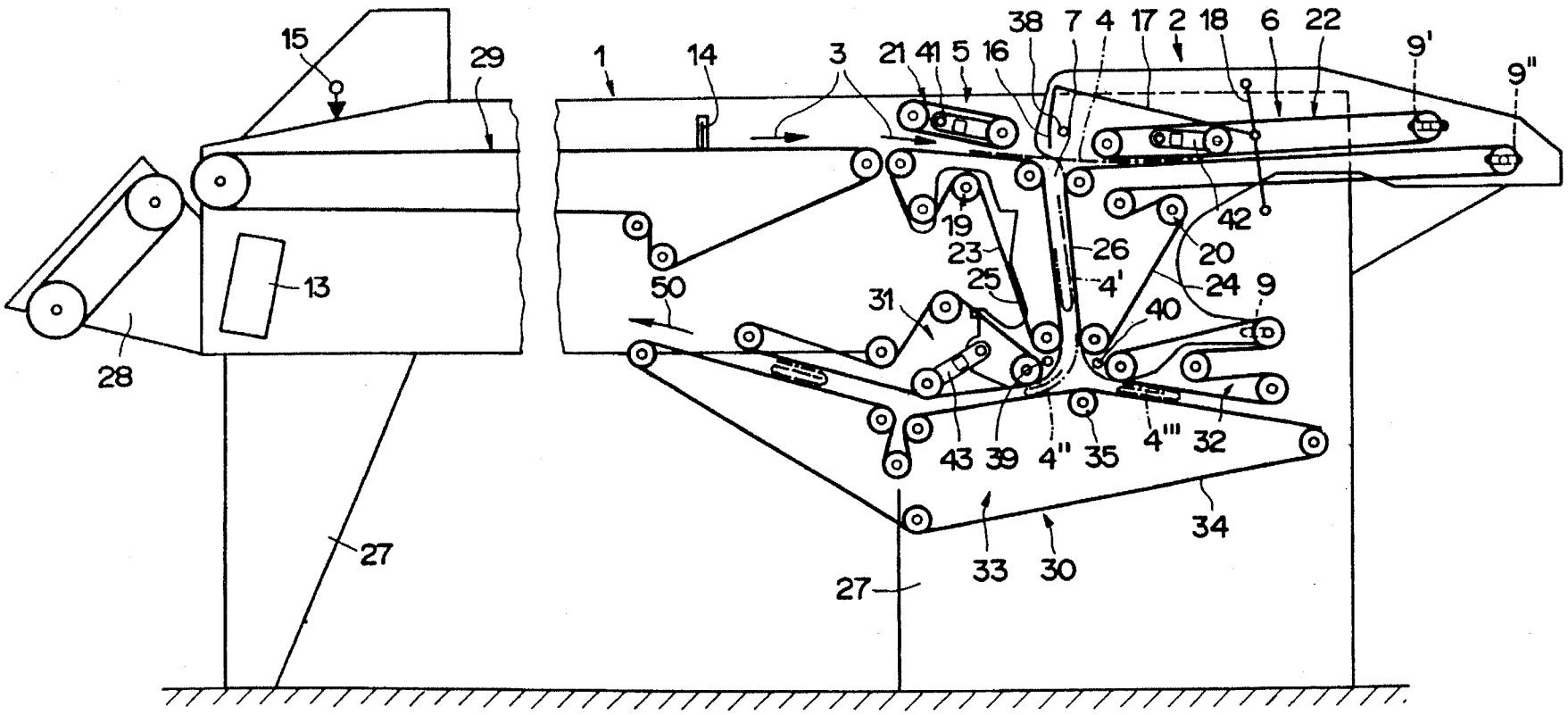
FIG. 1 shows schematically a side view of a folding apparatus with the longitudinal folder and the transverse folder disposed one behind the other, FIGS. 2, 3, and 4 each show schematically an enlarged section of the transverse folder of FIG. 1, the gap width being large in FIG. 2, the gap width being of medium size in FIG. 3 and the gap width being small in FIG. 4.

The folding apparatus according to FIG. 1 comprises a longitudinal folder 1, and a subsequently disposed transverse folder 2. Both the longitudinal folder and the transverse folder have a machine frame 27, which could also be conceived as being a joint machine frame. The longitudinal folder 1 has a feed conveyor 28, on which a flatwork article to be folded can be placed, spread out, to be subsequently introduced into the longitudinal folder. The longitudinal folder comprises essentially a longitudinal conveyor 29, on which is placed the flatwork article which is to be given one or two longitudinal folds. The flatwork article has been transferred to the longitudinal conveyor 29 by the feed conveyor. In the longitudinal folder, using folding blades, not depicted, which can run parallel to the longitudinal conveyor 29, one or both sides of the flatwork article are turned in toward the center to form one or two longitudinal folds. After the longitudinal folds have been made, the flatwork article is transported further by the longitudinal conveyor 29 into the transverse folder 2. Reference numeral 3 designates the conveying direction. The transverse folder has two laundry conveyors 5, 6, operated one after the other, seen in the conveying direction indicated. A first laundry conveyor 5 directly adjoins the longitudinal conveyor 29 and a second laundry conveyor 6 comes after the first laundry conveyor 5, viewed always in the conveying direction 3. There is a gap 7 between the two said laundry conveyors 5, 6. The first laundry conveyor 5 has a frame mounted stationary on the machine frame comprises a first lower conveyor section 19 and a first upper conveyor section 21. The second laundry conveyor 6 comprises a second lower conveyor section 20 and a second upper conveyor section 22. The two lower conveyor sections have, like all other conveyors or conveyor sections, circulatory belts disposed next to each other transversely to the transverse folder. These are designated by 23 in the first lower conveyor section and by 24 in the second lower conveyor section. The circulatory path of these belts in each of the said lower conveyor sections is essentially L-shaped. One leg each of the said conveyor sections is disposed approximately horizontally and forms the feed stretch of a flatwork article, designated 4, into the transverse folder. The other legs of the L of the two lower conveying sections are turned toward each other, but are spaced apart. The width of the said gap 7 is formed by the distance of the two spaced leg sections, these including leg section 25 of the first lower conveyor section 19 and leg section 26 of the second lower conveyor section 20. The depth of the gap, which extends downward preferably at about a right angle from the essentially horizontal feed plane for the flatwork article 4, is likewise determined by the length of the said leg sections 25, 26. From the deflection rollers, visible in the figures but which have not been given reference numerals, the circulatory path of the belts 23, 24 of the lower conveyor sections can be followed. This applies likewise to the two upper conveyor sections 21, 22, whose belts revolve in each case around two rollers spaced apart. The first upper conveyor section 21 comprises a pressing device 41 with which this conveyor section is pressed resiliently on the associated lower conveyor section 19. The upper conveyor section 22 of the second laundry conveyor 6 comprises a pressing device 42 of the same kind, which has the task of pressing the upper conveyor section 22 resiliently against the associated lower conveyor section 20 of the second laundry conveyor.

A further laundry conveyor 30 is disposed below the first and second laundry conveyors 5, 6. It extends essentially in horizontal direction and about parallel to the feed plane of the flatwork article 4 characterized by conveying direction 3. The laundry conveyor 30 comprises a first upper conveyor section 31, a second upper conveyor section 32 and a lower conveyor section 33. The first upper conveyor section 31 is disposed below the first lower conveyor section 19 of the first laundry conveyor 5 and the second upper conveyor section 32 is disposed below the second lower conveyor section 20 of the second laundry conveyor 6. The lower conveyor section 33 of the further laundry conveyor 30 extends from the lower end of gap 7 to the right and left beyond the horizontal length of the two said upper conveyor sections 31, 32.

The first upper conveyor section 31 forms together with the lower conveyor section 33 of the further laundry conveyor 30 a discharge conveyor for a completely folded flatwork article. The discharge point and discharge direction are marked by the reference numeral 50. The circulatory belts of the lower conveyor section 33 of the further laundry conveyor 30 have the reference numeral 34. A further pressing device 43 holds the belts of the first upper conveyor section 31 resiliently against the belts 34 of the lower conveyor section. Labelled 8 is one of two side walls spaced apart from each other between which the second laundry conveyor 6 and a part of the second upper conveyor section 32 are mounted and together with which the laundry conveyor 6 and the part of the second upper conveyor section 32 are displaceable in horizontal direction. Marked 9, 9' and 9" are displacement guides for the side walls 8, relative to the machine frame 27. Through displacement of the side walls 8, the gap width 7 is enlarged or reduced. Designated 38, 39 and 40 is the air blast tube stretching essentially over the entire width of the transverse folder; compressed air is emitted from the air blast tube making, or helping to make a transverse fold. Located centrally above the gap is a folding blade 16 which is intended to introduce a flatwork article 4 into the gap. It is linked to the one end of a blade lever 17 whose other end is pivotably connected centrally to a pivoted lever 18. The lower end of the pivoted lever 18 is pivotably disposed on the machine frame 27 and the upper end of the said pivoted lever 18 is pivotably connected to the side walls 8.

In displacing the side walls 8 relative to the machine frame 27 in the horizontal direction predetermined by the displacement guides 9, 9', 9", the folding blade 16 is displaced only by half the spacing of the side walls 8, owing to the central placement on the pivoted lever 18. Achieved thereby is that the folding blade always lies centrally with respect to the gap 7.

Described in the following discussion will be an example of transverse folding, referring to the flatwork article designated 4, 4', 4", 4'''. From the longitudinal conveyor 29, the flatwork article moves in the direction 3 indicated to the transverse folder 2, passing over the first laundry conveyor 5 and the second laundry conveyor 6. At the place where a first transverse fold is supposed to be made, the operational movement of the second laundry conveyor 6 is reversed, the folding blade lowered by a drive means, not shown, and compressed air blown out of the air blast tube to supplement the folding blade. While a first transverse fold is made, the flatwork article reaches the gap 7. This position of the flatwork article is marked 4'. Upon leaving the gap 7 at its lower end, the flatwork article is turned to the right or to the left, depending upon the operational direction of the belts of the further laundry conveyor 30. An operational direction from right to left is assumed in our example. The flatwork article 4' upon leaving the gap 7 is turned to the left in a first phase, up to about the position marked 4". Now the reversal of the operational direction of further laundry conveyor 30 takes place, and at the same time air blast tube 39 is actuated to emit compressed air. While a second transverse fold is made, the flatwork article arrives between the second upper conveyor section 32 and the lower conveyor section 33 of the further laundry conveyor 30. This position is designated by 4'''. The flatwork article has now been completely folded. The operational direction of the further laundry conveyor 30 is now reversed once more so that the flatwork article moves between the first upper conveyor section 31 and the lower conveyor section 33 of the further laundry conveyor 30 and ends up at the discharge point 50. Depending upon whether the leading edge of a flatwork article is supposed to lie on the inside or the outside, the folding step can differ. Following passage through the gap 7, the flatwork article can be turned first to the right, and then while a second transverse fold is made, to the left and can be discharged at once. In this case the air blast designated 40 serves the formation of the second transverse fold.

The invention provides for changing the gap width 7 according to the type of flatwork article, depending upon whether a thick or thin flatwork article has to be tranversely folded, and, at the lower end of the said gap, to adjust the path of belts 34 of the lower conveyor section 33 of the further laundry conveyor 30, depending upon, on the one hand, in which direction a flatwork article leaving the gap should be turned first, and, on the other hand, whether a completely folded flatwork article is supposed to be carried out of the folding apparatus. These steps will be further described later.

The adjustment of the gap width depends in any case upon the thickness of the flatwork article to be folded. Three different variants are provided for to cover the type, or respectively thickness, of a flatwork article to be folded. The type of flatwork article can be entered into a data entry device 13, for example, by an operator. The type of flatwork article can also be determined based on its length, as previously explained. For example, to determine the length, a light barrier, designated 15, is provided in the longitudinal folder. The light barrier could also be disposed at another location, for example at the point where the flatwork article enters the transverse folder 2. Foreseen as another possibility is direct measurement of the thickness of the flatwork article. This can take place, for example, by means of a light barrier, designated 14, which emits a band of light tranversely to the conveying direction 3, the amount of interruption of the band of light depending upon the height of the flatwork article lying on the longitudinal conveyor 29.

Figure 2:
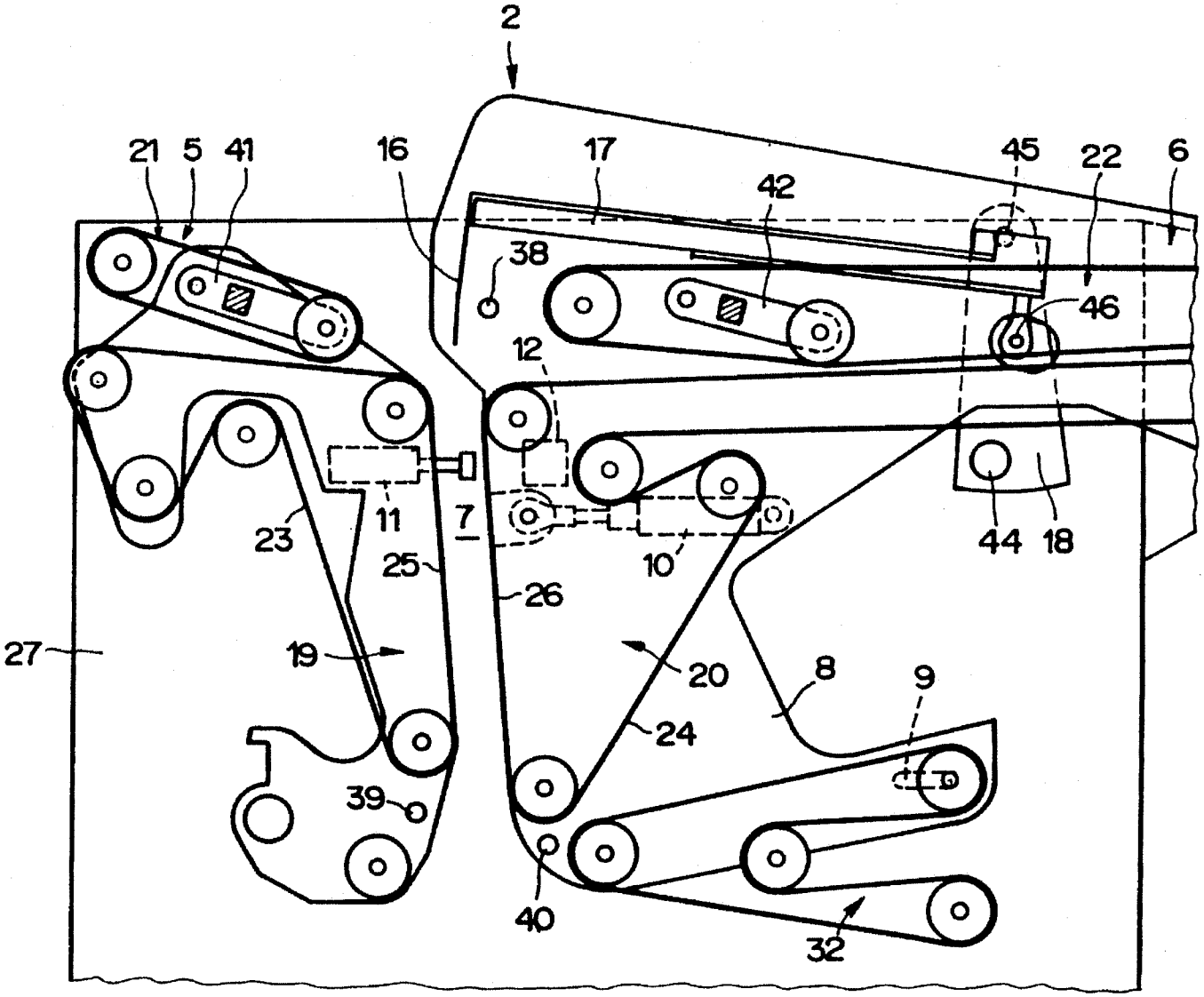
Figure 3:
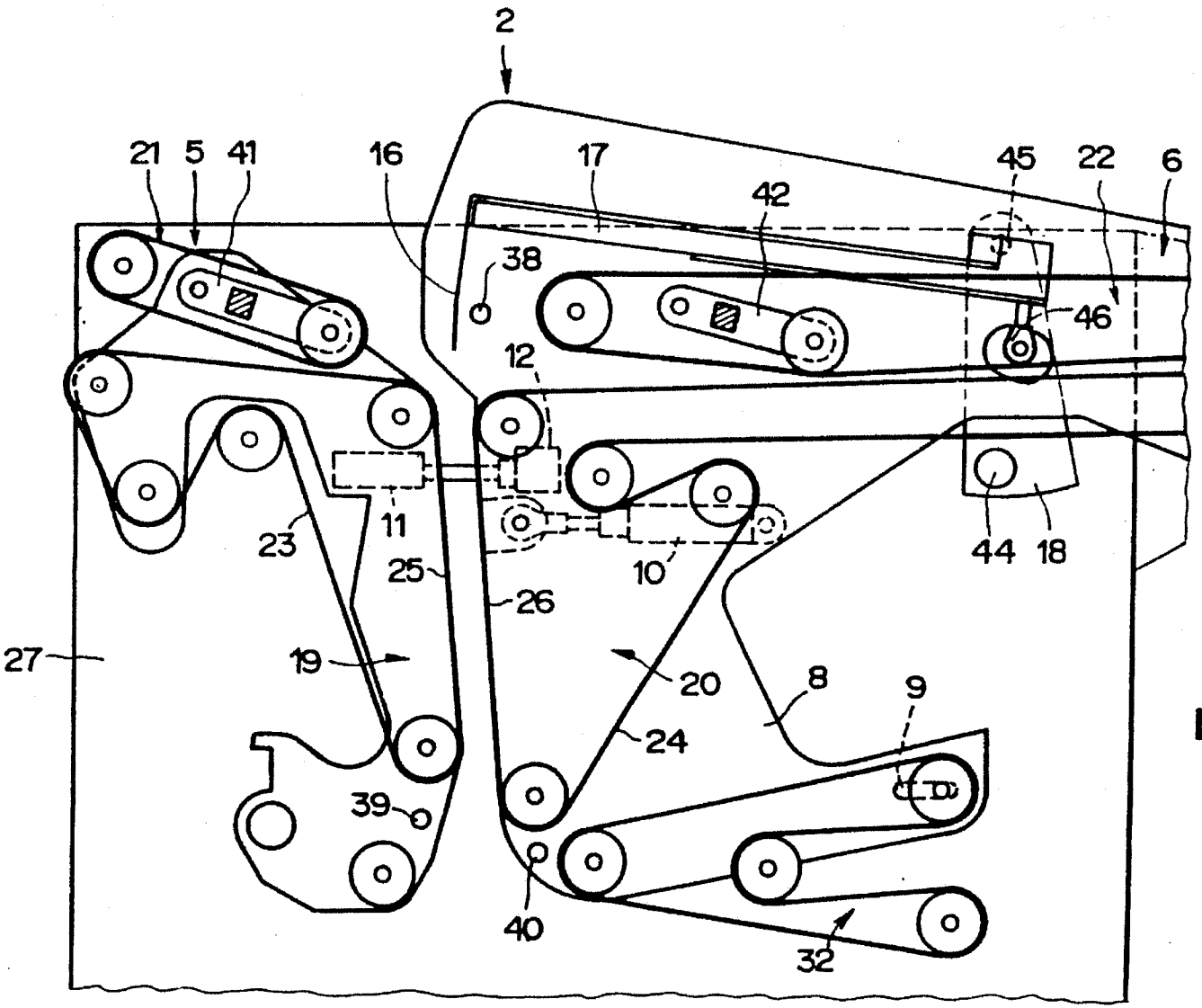
Figure 4:
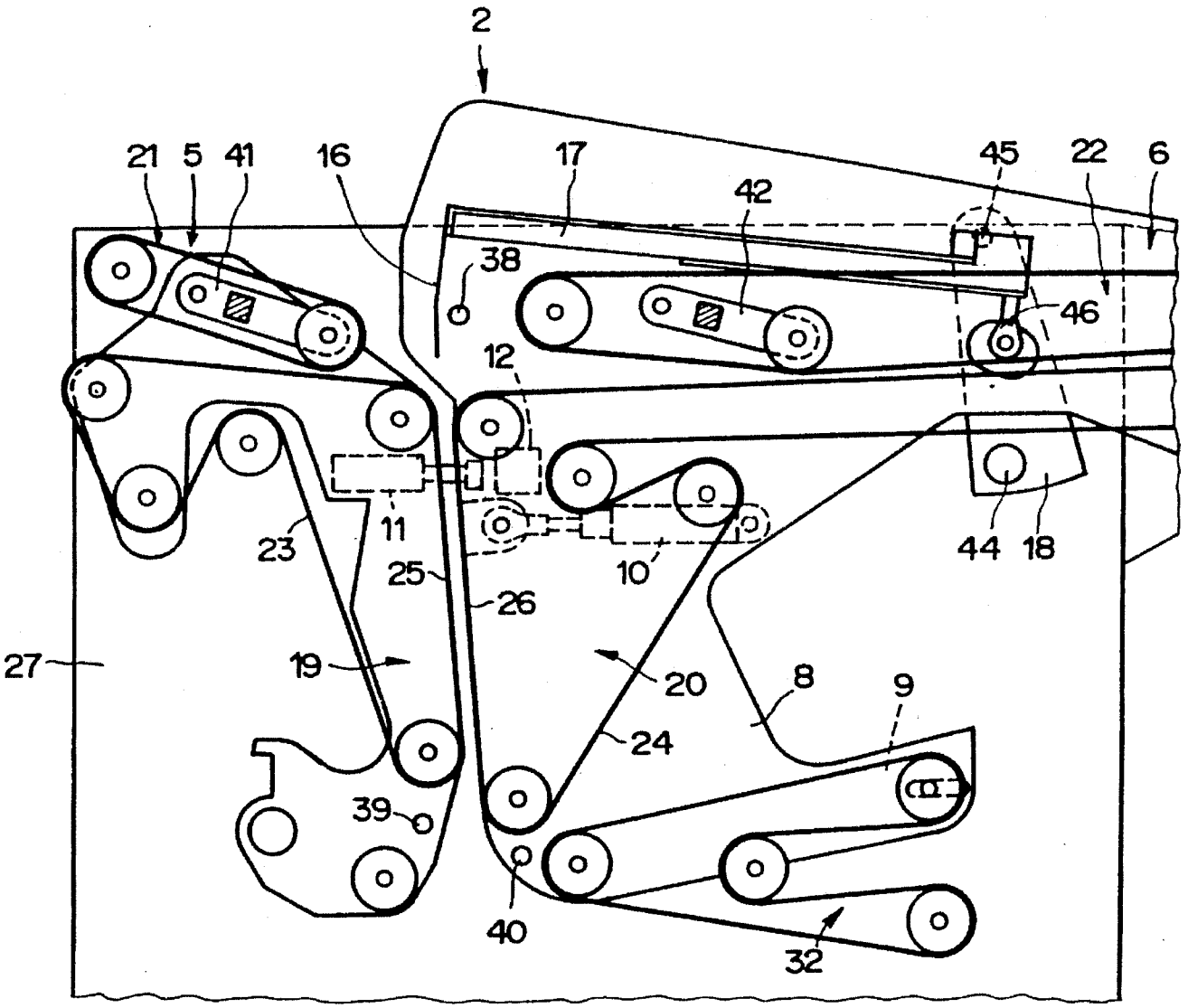

Using a signal from the data entry device 13, the light band 14 or the light barrier 15, which is evaluated in a control unit not shown, an adjustment of the gap width is undertaken. This is shown by FIGS. 2, 3, and 4. These figures show only part of the transverse folding device. The further laundry conveyor 30, which is disposed below the gap 7, has been omitted.

Designated by 10, 11, and 12 are means to adjust the gap width 7. A first pneumatic cylinder 10 is mounted in horizontal position parallel to displacement guide 9. Its front end is connected to the machine frame 27, and its rear end is fastened to the side wall 8. By driving the piston rod of this cylinder in and out, the second laundry conveyor 6 can be driven closer to the first laundry conveyor 5 or farther away therefrom. The gap width is changed thereby.

Shown in FIG. 2 is the maximum possible gap width 7. The folding blade, which is linked to the blade lever 17, is visible centrally above the opened gap 7. The end of the blade lever 17 remote from the folding blade 16 is pivotably disposed on the pivoted lever 18 by means of blade lever pivot bearing 46. The pivoted lever 18, which is plate-shaped in design, has a lower pivot point pivotable about a shaft 44 connected to the machine frame 27 and a upper pivot point disposed on the side wall 8 and designated by reference numeral 45.

Shown in FIG. 3 is a medium gap width 7. The first pneumatic cylinder 10 is pressurized with compressed air to extend its piston. Prior thereto, the piston rod of a second pneumatic cylinder 11, which is fixed to the first laundry conveyor 5, is completely driven out or extended. By driving out the piston rod of the first pneumatic cylinder 10, the second laundry conveyor 6 is advanced toward the first laundry conveyor 5, the width of gap 7 growing smaller, and this continues until a limit stop 12 connected to one of the side walls 8 touches the extended piston rod of the second pneumatic cylinder 11. Since the pressurization of the first pneumatic cylinder 10 is less than the pressurization of the second pneumatic cylinder 11, the second laundry conveyor remains in the position shown in FIG. 3.

The smallest possible gap width is presented in FIG. 4. The piston rod of the second pneumatic cylinder 11 is completely driven in and the piston rod of the first pneumatic cylinder 10 is driven completely out. Owing to the reduced pressurization of the first pneumatic cylinder 10, which is achieved, for example, by means of a pressure reduction valve, which is connected in series to the first 'pneumatic' cylinder and which is not shown, a spring action of the second laundry conveyor 6 can be maintained in the direction of its displacement movement.

In FIGS. 2, 3, and 4, one also notes the position of the folding blade 16 which position is always directed at the center of gap 7.

Figure 5:
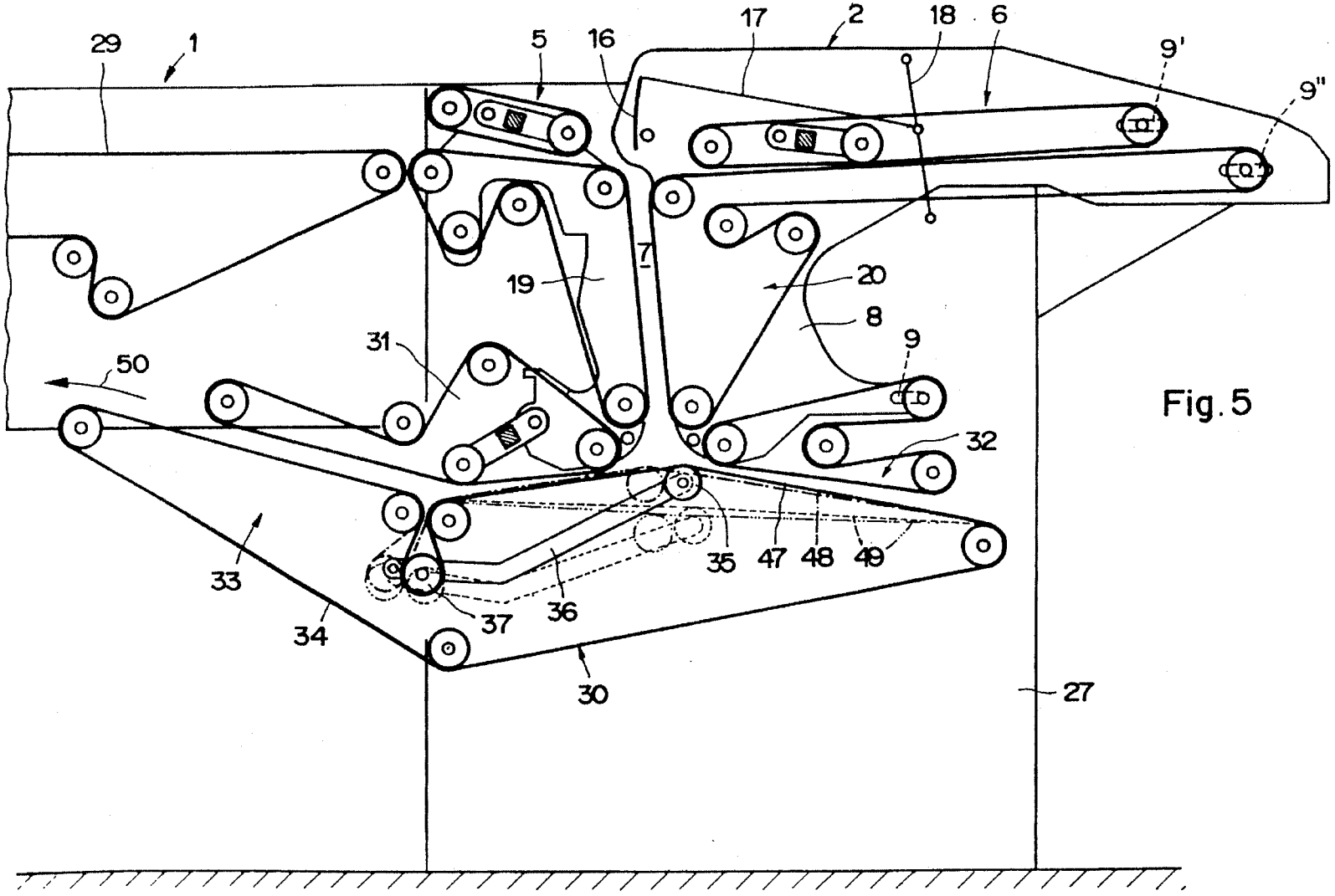
FIG. 5 shows enlarged a side view of the transverse folder, the adjustment possibility of the belts of the discharge conveyor being particularly portrayed.

Shown in FIG. 5 is the adjustment possibility of the belts 34 of the lower conveyor section 33 of the further laundry conveyor 30. An adjusting roller 35, disposed in the area of the lower end of gap 7 below belts 34, is displaceably mounted to change the circulatory path of the belts in the said area. Also mounted displaceably is a length compensating roller 37 which is disposed along the circulatory path of belts 34. It serves to keep belts 34 tensioned during adjustment of adjusting roller 35. In the embodiment shown, adjusting roller 35 is connected to length compensating roller 37 by means of bars 36, depicted only symbolically. Pneumatic cylinders, for example, which are not shown, acting upon the bars are intended for adjustment thereof.

The thickly drawn line of belts 34 in FIG. 5 labelled 47 indicates the position of the adjusting roller and the course of belts 34 which is assumed to create a second transverse fold when the leading edge of the flatwork article, as shown in FIG. 1, is supposed to lie on the outside.

If the flatwork article is supposed to be folded so that the leading edge lies on the inside, then the adjusting roller and correspondingly the length compensating roller are brought into the position in which belts 34 assume the course indicated by the line of dots and dashes labelled 48.

To carry out a completely folded flatwork article, the adjusting roller 35 and the length compensating roller 37 are lowered so that the belts takes the course indicated by the line of dashes or the line of alternating dashes and three dots labelled 49. The inlet for the flatwork article between the first upper conveyor section 31 and the lower conveyor section 33 of the further laundry conveyor 30 is thereby enlarged. The inlet location forms essentially a V, whose legs run toward each other, directed toward the discharge point 50. A piling up of a flatwork article is thereby avoided.

Control of the various depicted and undepicted cylinders as well as the reversal of operational direction of the different laundry conveyors takes place by means of a control unit not shown. This unit receives the signals necessary for control from transmitters, not shown, designed preferably as further light barriers, along the path of conveyance of the flatwork article to be folded.

What is claimed is:

1. A folding apparatus for automatic folding of flatwork, in particular articles of clothing, comprising:

a machine frame, a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and being spaced part by a gap stretching across an entire width dimension of the transverse folder wherein the flatwork article is introduced into the gap to make a first transverse fold, means for determining at least one of the thickness and length of the flatwork article to be folded, means for changing the width of the gap and for adjusting the gap based on said at least one of the thickness and length of the flatwork article before the flatwork article is introduced in the gap;

a folding blade provided over the gap and mounted on the frame so as to be lowerable toward the gap; and a third conveyor located below said folding blade and receiving the flatwork article after being folded by the folding blade, said third conveyor further folding the flatwork article.

2. A folding apparatus as set forth in claim 1, wherein the determining means has a data entry device to enter data therein as to the type of flatwork article detected by the determining means.

3. A folding apparatus as set forth in claim 1, wherein the determining means has a measuring device measuring the thickness of the flatwork article and wherein the thickness indicates the type of flatwork article.

4. A folding apparatus as set forth in claim 1, wherein the determining means has a measuring device measuring the length of the flatwork article and wherein the measured value indicates the type of flatwork article.

5. A folding apparatus as set forth in claim 1, wherein a frame portion of the first laundry conveyor is mounted so as to be stationary on the machine frame and the second laundry conveyor is displaceably disposed on the machine frame to change the width of the gap.

6. A folding apparatus as set forth in claim 5, wherein the means for changing the width of the gap is connected to the second laundry conveyor so that the width of the gap is adjustable to at least two predefined sizes.

7. A folding apparatus for automatic folding of flatwork, in particular articles of clothing, comprising:

a machine frame, a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and being spaced apart by a gap stretching across an entire width dimension of the transverse folder wherein the flatwork article is introduced into the gap to make a first transverse fold, means for determining at least one of the thickness and length of the flatwork article to be folded, means for changing the width of the gap and for adjusting the gap based on said at least one of the thickness and length of the flatwork article before the flatwork article is introduced in the gap; and a folding blade provided over the gap above the first and the second laundry conveyors, means for lowering the folding blade to introduce the folding blade into the gap, said means for lowering the blade having a pivoted lever and the folding blade being coupled to the pivoted lever substantially centrally of the pivoted lever wherein a first end of the pivoted lever is pivotally connected to the machine frame and a second end of the pivoted lever is coupled to the second laundry conveyor.

8. A folding apparatus for automatic folding of flatwork, in particular articles of clothing, comprising:

a machine frame, a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and being spaced apart by a gap stretching across an entire width dimension of the transverse folder wherein the flatwork article is introduced into the gap to make a first transverse fold, means for determining at least one of the thickness and length of the flatwork article to be folded, means for changing the width of the gap and for adjusting the gap based on said at least one of the thickness and length of the flatwork article before the flatwork article is introduced in the gap wherein the first and the second laundry conveyors each has a lower conveying section on which circulatory belts are respectively disposed, each of the belts having a circulatory path essentially L-shaped, the gap being formed between and along two leg sections of the belts of the first and the second laundry conveyors turned toward each other and running parallel to each other, and extending at substantially a right angle to the said conveying direction.

9. A folding apparatus for automatic folding of flatwork, in particular articles of clothing, comprising:

a machine frame, a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and being spaced apart by a gap stretching across an entire width dimension of the transverse folder wherein the flatwork article is introduced into the gap to make a first transverse fold, means for determining at least one of the thickness and length of the flatwork article to be folded, means for changing the width of the gap and for adjusting the gap based on said at least one of the thickness and length of the flatwork article before the flatwork article is introduced in the gap;

a further laundry conveyor located below said first and said second laundry conveyors, wherein the further laundry conveyor is reversibly driven and has two upper conveying sections and one lower conveying section, the first upper conveying section being disposed below the first laundry conveyor and the second upper conveying section being disposed below the second laundry conveyor, and the lower conveying section of the further laundry conveyor extending below the two upper conveying sections, each of said conveying sections having circulatory belts defining a circulatory path, and adjusting means for changing the circulatory path of the belt of the lower conveying section of the further laundry conveyor in a lower area of the gap.

10. A folding apparatus as set forth in claim 9, wherein the adjustment means brings the circulatory path of the belts in said lower area of the gap to one of a first position in proximity to a lower front gap end defined by the first laundry conveyor, a second position in proximity to a lower rear gap end defined by the second laundry conveyor to make further transverse folds in the flatwork article, and a third position wherein the circulatory path is spaced away from the gap to carry the completely folded flatwork article out of the transverse folder.

11. A folding apparatus for automatic folding of flatwork, in particular articles of clothing, comprising:

a machine frame, a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and positioned one behind the other in the conveying direction and being spaced apart by a gap stretching across an entire width dimension of the transverse folder wherein the flatwork article is introduced into the gap to make a first transverse fold, a mechanism determining at least one of the thickness and length of the flatwork article to be folded, and a mechanism changing the width of the gap and adjusting the gap based on said at least one of the thickness and length of the flatwork article before the flatwork article is introduced in the gap;

a folding blade provided over the gap and mounted on the frame so as to be lowerable toward the gap; and a third conveyor located below said folding blade and receiving the flatwork article after being folded by the folding blade, said third conveyor further folding the flatware article.

12. A folding apparatus as set forth in claim 11, wherein the determining mechanism has a data entry device to enter data therein as to the type of flatwork article detected by the determining mechanism.

13. A folding apparatus as set forth in claim 11, wherein the determining mechanism has a measuring device measuring the thickness of the flatwork article and wherein the thickness indicates the type of flatwork article.

14. A folding apparatus as set forth in claim 11, wherein the determining mechanism has a measuring device measuring the length of the flatwork article and wherein the measured value indicates the type of flatwork article.

15. A folding apparatus as set forth in claim 11, wherein the first laundry conveyor has a frame which is mounted so as to be stationary on the machine frame and the second laundry conveyor is displaceably disposed on the machine frame and changes the width of the gap.

16. A folding apparatus as set forth in claim 15, wherein the mechanism changing the width of the gap is connected to the second laundry conveyor so that the width of the gap is adjustable to at least two predefined sizes.

17. A folding apparatus for automatic folding of flatwork, in particular articles of clothing, comprising:

a machine frame;

a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely;

a first laundry conveyor and a second laundry conveyor disposed in the transverse folder and positioned one behind the other in the conveying direction and being spaced apart by a gap stretching across an entire width dimension of the transverse folder wherein the flatwork article is introduced into the gap to make a first transverse fold;

a mechanism determining at least one of the thickness and length of the flatwork article to be folded;

a mechanism changing the width of the gap and adjusting the gap based on said at least one of the thickness and length of the flatwork article before the flatwork article is introduced in the gap; and a folding blade provided over the gap above the first and the second laundry conveyors, a mechanism lowering the folding blade and introducing the folding blade into the gap, said mechanism lowering the blade having a pivoted lever and the folding blade being coupled to the pivoted lever substantially centrally of the pivoted lever wherein a first end of the pivoted lever is pivotally connected to the machine frame and a second end of the pivoted lever is coupled to the second laundry conveyor.

18. A folding apparatus for automatic folding of flatwork, in particular articles of clothing, comprising:

a machine frame;

a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely, a first laundry conveyor and a second laundry conveyor disposed in the transverse folder and positioned one behind the other in the conveying direction and being spaced apart by a gap stretching across an entire width dimension of the transverse folder wherein the flatwork article is introduced into the gap to make a first transverse fold;

a mechanism determining at least one of the thickness and length of the flatwork article to be folded; and a mechanism changing the width of the gap and adjusting the gap based on said at least one of the thickness and length of the flatwork article before the flatwork article is introduced in the gap;

wherein the first and the second laundry conveyors each has a lower conveying section on which circulatory belts are respectively disposed, each of the belts having a circulatory path essentially L-shaped, the gap being formed between and along two leg sections of the belts of the first and the second laundry conveyors turned toward each other and running parallel to each other, and extending at substantially a right angle to the said conveying direction.

19. A folding apparatus for automatic folding of flatwork, in particular articles of clothing, comprising:

a machine frame;

a longitudinal folder and a transverse folder positioned in proximity with the longitudinal folder, wherein a flatwork article to be folded is conveyed first through said longitudinal folder, is folded therein longitudinally and is afterward conveyed through said transverse folder and is folded therein transversely;

a first laundry conveyor and a second laundry conveyor disposed in the transverse folder and positioned one behind the other in the conveying direction and being spaced apart by a gap stretching across an entire width dimension of the transverse folder wherein the flatwork article is introduced into the gap to make a first transverse fold;

a mechanism determining at least one of the thickness and length of the flatwork article to be folded;

a mechanism changing the width of the gap and adjusting the gap based on said at least one of the thickness and length of the flatwork article before the flatwork article is introduced in the gap;

a further laundry conveyor located below said first and said second laundry conveyors, wherein the further laundry conveyor is reversibly driven and has two upper conveying sections and one lower conveying section, the first upper conveying section being disposed below the first laundry conveyor and the second upper conveying section being disposed below the second laundry conveyor, and the lower conveying section of the further laundry conveyor extending below the two upper conveying sections, each of said conveying sections having circulatory belts defining a circulatory path, and an adjusting mechanism changing the circulatory path of the belt of the lower conveying section of the further laundry conveyor in a lower area of the gap.

20. A folding apparatus as set forth in claim 19, wherein the adjustment mechanism brings the circulatory path of the belts in the said lower area of the gap to one of a first position in proximity to a lower front gap end defined by the first laundry conveyor, a second position in proximity to a lower rear gap end defined by the second laundry conveyor to make further transverse folds in the flatwork article, and a third position wherein the circulatory path is spaced away from the gap to carry the completely folded flatwork article out of the transverse folder.

* * * * *